US005241908A

United States Patent [19]

Tateishi

[11] Patent Number: 5,241,908

[45] Date of Patent: Sep. 7, 1993

[54] WASHING DEVICE OF A PRINTING DEVICE

[75] Inventor: Haruki Tateishi, Itabashi, Japan

[73] Assignee: Nikka Kabushiki Kaisha, Tokyo, Japan

[21] Appl. No.: 897,429

[22] Filed: Jun. 12, 1992

[30] Foreign Application Priority Data

Dec. 16, 1991 [JP] Japan ..... 3-352654

[51] Int. Cl.[5] ..... A41F 35/04; A41F 35/00

[52] U.S. Cl. ..... 101/423; 101/425; 15/345

[58] Field of Search ..... 101/423–425; 15/345, 346

[56] References Cited

U.S. PATENT DOCUMENTS

| | | | |
|---|---|---|---|
| 3,835,779 | 9/1974 | Ross et al. | 101/425 |
| 4,594,748 | 6/1986 | Warfuinge | 15/345 |
| 4,727,614 | 3/1988 | Swistun | 15/345 |
| 4,841,862 | 6/1989 | Seefried | 101/423 |
| 4,861,178 | 8/1989 | Reed | 101/424.1 |
| 4,972,780 | 11/1990 | Gasparrini et al. | 101/425 |
| 5,010,819 | 4/1991 | Uribe et al. | 101/425 |
| 5,086,701 | 2/1992 | Gasparrini et al. | 101/423 |
| 5,163,369 | 11/1992 | Howitt | 101/423 |

OTHER PUBLICATIONS

Catalogue for Ryco Dry Blanket Cleaning System; Ryco Graphic Manufacturing, Inc.; Wheeling, Ill.

Catalogue for Baldwin Automatic Blanket Cleaners Rotary Dry Brush System—Model 1330; Baldwin Graphic Products, Stamford, Conn.

*Primary Examiner*—Edgar S. Burr
*Assistant Examiner*—Lynn D. Hendrickson
*Attorney, Agent, or Firm*—Oliff & Berridge

[57] ABSTRACT

To clean dusts from a printing cylinder of a blanket, an impression drum or the like can be simply discharged with no adhesion in a casing of a cleaning machine. A cleaning device incorporates a rotary brush in the casing which is disposed opposite to the printing cylinder. An opening is formed in a cylinder confronting portion of the casing, and the cylinder surface can be cleaned by the brush, with some portion of the brush fronting. Provided in the casing is a scraper for eliminating the adhered substances while contacting the brush. A dust discharge port is formed in the wall surface of the casing, and an air blowout means for forming an air layer is provided in the bottom portion of the casing. The dusts taken in by the brush are carried through the air layer to the discharge port while floating the dusts and can be discharged from the discharge port.

7 Claims, 3 Drawing Sheets

WASHING DEVICE OF A PRINTING DEVICE

BACKGROUND OF THE INVENTION

Field of the Invention

The present invention relates to a cleaning device of a printing cylinder and, more particularly, to a cleaning device structured suitably for cleaning off paper powder and ink residues adhered to a blanket cylinder or the like by using a rotary brush.

A conventional device for cleaning the blanket cylinder by use of a rotary brush includes an opening formed in a box-like casing. The rotary brush is encased in the casing, with some portion thereof fronting from this opening. A brush roll is rotationally driven by a motor. The brush fronting from the opening rotationally contacts the blanket cylinder, whereby the paper powder and ink residues are scraped off from the cylinder surface by the brush. The casing encases a scraper which contacts the brush. The dusts adhered to the brush are removed and temporarily accommodated in the casing. Then, the bottom of the casing is opened every time the cleaning process has been finished or periodically, the dusts accommodated therein are abandoned.

The conventional method, however, presents such a problem that the dusts accommodated in the casing are, if left for a long time, adhered to the bottom of the casing because of the paper powder containing the ink and ink residues, resulting in a difficulty to clean the casing. It is therefore considered that the casing is frequently cleaned, or alternatively a forcible exhaust is effected by vacuum suction with a vacuum unit connected to the casing.

However, if the cleaning frequency increases as in the former case, this involves a stop of the printing operation and is not therefore realistic. In the latter case, though effective because of performing the continuous suction exhaust, it is required that a vacuum area be formed entirely within the elongate cleaning casing. In this case, a large-sized vacuum unit is needed. This is still an ineffective method.

SUMMARY OF THE INVENTION

It is a primary object of the present invention in which the attention is paid to the forgoing problems inherent in the prior art to provide a cleaning device of a printing cylinder having a structure capable of simply discharging the dusts cleaned off without adhering the dusts within the casing of a cleaning machine.

To accomplish the above-described object, according to one aspect of the invention, there is provided a cleaning device of a printing cylinder, comprising: a casing disposed opposite to the printing cylinder and formed with an opening in a confronting surface of the cylinder; a rotary brush encased in the casing and capable of brush-cleaning the surface of the printing cylinder while being rotationally driven with some portion fronting from the opening; a scraper, disposed in the casing, for eliminating adhered substances while contacting the rotary brush; a dust discharge port, formed in the casing, for generating a suction negative pressure; and an air blowout means for forming an air layer in the bottom of the casing and flowing the air layer towards the discharge port while floating the dusts taken in from the brush.

Based on this construction, the air layer is formed in the bottom of the casing. Hence, the ink residues and paper powder scraped off by the brush roll are scattered into the air layer by means of the scraper. These dusts assume a floating state through the air layer and are not therefore adhered to the internal wall of the casing. Besides, the air layer flows towards the dust discharge port, and the dust also flow together and smoothly discharged outside. This process is continuously executed during the cleansing operation, whereby the interior of the casing can be always kept clean.

In this case, the dust discharge port may be, though a suction negative pressure is caused by the ejector, connected directly to a vacuum unit. In any case, the dusts can be effectively discharged by a small negative pressure.

This construction exhibits such an excellent effect that the dusts can be discharged from the discharge port while floating the dusts taken in from the rotary brush; and the dusts cleaned off can be simply discharged with no adhesion in the casing of the cleaning machine.

BRIEF DESCRIPTION OF THE DRAWINGS

Other objects and advantages of the present invention will become apparent during the following discussion taken in conjunction with the accompanying drawings, in which.

DESCRIPTION OF THE PREFERRED EMBODIMENT

A concrete embodiment of a cleaning device of a printing cylinder according to the present invention will hereinafter be described in detail with reference to the drawings.

Figure 1:
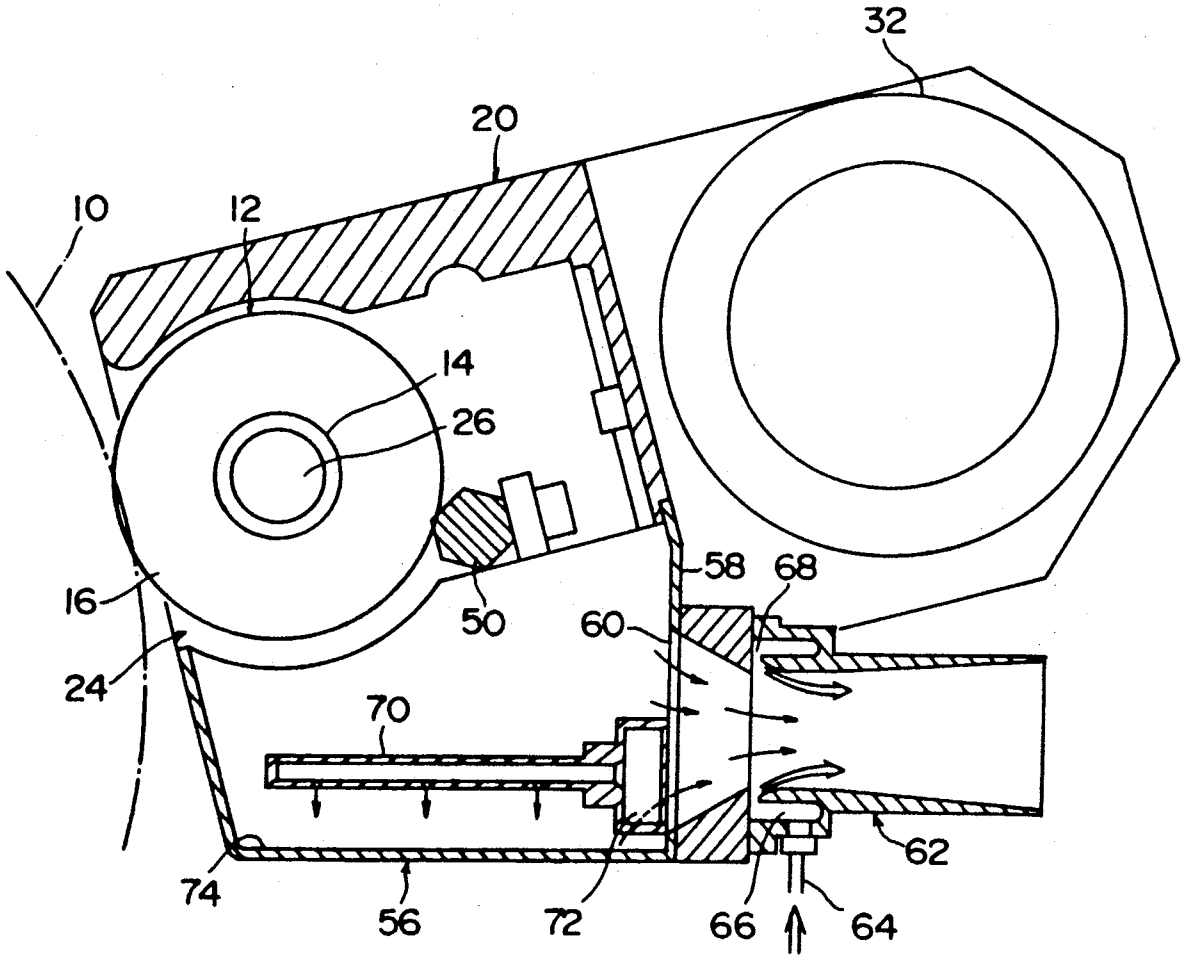
FIG. 1 is a side sectional view illustrating a cleaning device in an embodiment.
Figure 2:
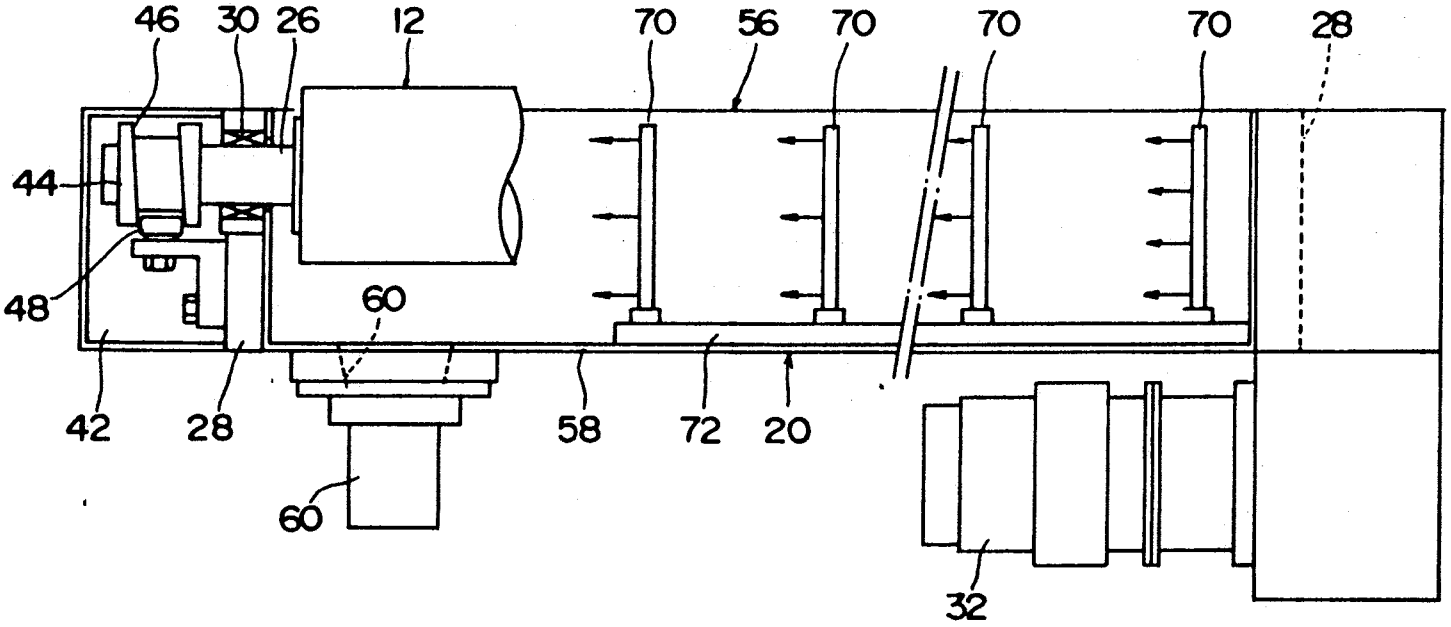
FIG. 2 is a plan sectional view depicting the same device.

FIGS. 1 and 2 are side and plan sectional views illustrating the cleaning device in the embodiment. As illustrated in these Figures, this cleaning device aims at cleaning a blanket drum 10 as a printing cylinder and includes a dry brush roll 12 movable to and fro with respect to this blanket drum 10. This brush roll 12 is constructed in such a way that a base cloth embedded with brush fibers 16 is wound on and integrally bonded to an outer peripheral surface of a cylindrical roll core 14. Each brush fiber 16 of the thus constructed brush roll 12 is composed of a Nylon fiber having a diameter of approximately 0.2–0.3 $\phi$mm. Therefore, the brush fibers 16 confronting in the rotating direction of the blanket drum 10 clean the surface of the blanket drum 10 by performing scrape-sliding on the surface thereof with the fiber tips in the respective portions. The dry brush roll 12 has a roll length substantially equal to that of the blanket drum conceived as a cleaning object. The brush roll 12 is attached to a casing 20 so that the roll is movable to contact and separate from the blanket drum 10 while being rotationally driven.

The casing 20 is a box container for encasing the brush roll 12 and movable in an approaching or separating direction from the blanket drum 10. A window 24 is formed in the front surface confronting the blanket drum 10 in the thus arranged casing 20. A part of the brush roll 12 encased therein is protruded from this window 24. Rotary support shafts 26 are fitted to both ends of the brush roll 12 and inserted into end plates 28 provided on both sides of the casing 20 through a bearing 30. Further, for rotationally driving the brush roll 12, for instance, an air motor 32 is disposed in rear of the brush roll 12 and mounted on one end side of the casing 20 to provide a chamber separate from the casing 20. The brush roll 12 is thereby rotationally driven. Besides, an interior defined by the other end plate 28 and the casing side plate serves as a cam accommodating chamber 42. As illustrated in FIG. 2, a cylindrical cam 44 is secured to the roll rotary support shaft 26 protruding in this chamber. At this time, a cam roller 48 fitted in a cam groove 46 formed in an outer peripheral surface of the cylindrical cam 44 is mounted in a fixed position of the end plate 28. The cam groove 46 is formed along the surface oblique to the roll shaft, whereby the brush roll 12 itself reciprocates in the axial directions with rotations of the brush roll 12.

Further, a scraper 50 intruded into the brush of the brush roll 12 is provided in the interior of the casing 20. This scraper 50 is formed of an angular member having an equal or larger length than that of the brush roll 12. The scraper 50 is disposed in parallel to the roll 12 in the lower position of the brush roll 12; and an upper corner portion thereof is intruded thereinto with an overlap with the surface portion of the brush roll 12. Hence, the scraper 50 rotationally contacts the brush roll 12 in such a state that the corner thereof is intruded into the brush surface portion, thus scraping dusts intermingled in the brush fibers 16. The thus constructed scraper 50 is fixedly held in the interior of the casing 20.

On the other hand, a cassette container 56 attachable to and detachable from an upper casing is formed in the lower part of the casing 20. The container 56 is a dust collecting container of ink residues and paper powder which are taken into the casing 20 by peel-cleaning the surface of the blanket drum 10 with the brush roll 12 and then scraped off by the scraper 50.

A dust discharging device for favorably discharging the dusts collected is formed in the lower cassette container 56 constructed as the dust collecting container in the casing 20. More specifically, a dust discharge port 60 is formed in a position closer to the end portion of a back plate 58 in the cassette container 56. An ejector 62 is fitted thereto, thereby sucking and discharging the dusts within the cassette container 56 by generating a suction negative pressure. For this purpose, an air supply pipe 64 is connected to the ejector 62, and the compressed air is supplied to an internal annular chamber 66. Performed is a high-speed exhaust from a ring nozzle 68 formed in an inner peripheral surface. The negative pressure is thereby generated in the central part of a passage of the discharge port 60. The air containing the dusts is exhausted from the cassette container 56.

Figure 3:
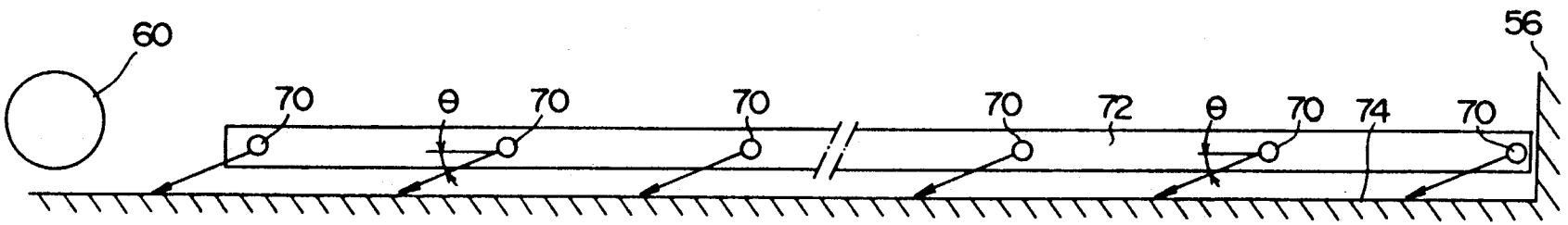
FIG. 3 is an explanatory schematic diagram showing nozzle pipes.

By the way, a sucking region by the ejector 62 is hard to act over the entire length of the cassette container 56. Hence, in accordance with this embodiment, an air jet nozzle pipe 70 is provided to form an air layer flowing towards the dust discharge port 60 in the bottom surface of the cassette container 56. A header member 72 is fitted to the back plate 58 so that the pipe 70 extends in the longitudinal direction of the cassette container 56. The pipe 70 protrudes from the header member 72 in the direction orthogonal to the brush roll 12. A plurality of pipes 70 are fitted at constant pitch intervals in the longitudinal direction of the container. Then, this nozzle pipe 70 is set at a constant level from a cassette container bottom 74. Each of the thus arranged nozzle pipes 70 is formed with an air-blow outlet. A blowout direction from this outlet is, as illustrated in FIGS. 2 and 3, set towards the above-mentioned dust discharge port 60; and a blowout angle $\theta$ is set at a downward angle of 20–25 degrees (22 degrees in the embodiment). The flowing air layer towards the discharge port 60 is formed in the bottom of the cassette container 56. In this case, in accordance with the embodiment, four nozzles are formed in the nozzle pipe 70 remotest from the discharge port 60. Other pipes 70 are each formed with three nozzles. A blowout pressure from the nozzle is set low enough to form the air layer but not to blow out the air from a gap of the window 24 between the cassette container 56 and the brush roll 12.

In the thus constructed cleaning device, the brush roll 12 rotationally contacts the surface of the blanket drum, thus removing the adhered substances such as ink, paper powder, etc. Namely, the blanket drum 10 rotates at 400–600 rpm in a state where the printing machine is operated. Therefore, an air motor 32 is actuated in advance of a start of the cleaning operation. The brush roll 12 is rotated with a constant number of revolutions within a range of 50–150 rpm in the direction opposite to the rotating direction of the blanket drum 10. A relative peripheral speed at the contact portion between the blanket drum 10 and the brush roll 12 is thereby set at 8–12 m/s. Then, the casing 20 is advanced towards the surface of the blanket drum 10 in the rotating state. The brush roll 12, the surface of which partly confronts from the window, is caused to contact therewith. The brush fibers are thereby intruded in between the adhering surface of the blanket drum 10 and the ink or paper powder, with the result that the adhered substances are peeled off and removed from the surface of the blanket drum 10. The adhered substances peeled and cleaned off enter between the brush fibers of the brush roll 12 and are scraped off from the fibers 16 by the scraper 50 within the casing 20. The adhered substances are thus dropped down to the lower portion of the casing 20.

In the lower portion of the casing 20, the low pressure air is blown out downwardly towards the dust discharge port 60 at one end from the respective nozzle pipes 70 arranged in the longitudinal direction. The air layer is thus formed in the bottom 74 of the cassette container 56. Therefore, the dusts separated by the scraper 50 float in the air layer and flow towards the discharge port 60. The ejector 62 is provided at the discharge port 60, and hence the flowing air layer is, when reaching the negative pressure area, exhausted at a high speed together with the dusts from the discharge port 60.

In the embodiment discussed above, especially the air nozzle is set at the downward angle $\theta$ (=22 degrees), and it is therefore possible to generate the negative pressure in the gap between the brush roll 12 and the window 24. The dusts are thereby prevented from being discharged outside from the gap. Exhibited is such an advantage that the cleaning effect by the dry brush roll 12 can be improved.

Note that the suction negative pressure is caused by the ejector 62 in the above-described embodiment, however, a vacuum unit as a substitute for this may be connected to the discharge port 60 to collect the dusts. Further, the air layer may be formed without depending on the nozzle pipes 70 and blown out from an air orifice formed in the bottom surface 74 of the cassette container 56.

Moreover, the blanket drum is the object for cleaning in the embodiment discussed above. The present invention is, however, applicable to a cleaning device wherein the impression drum or other printing cylinders are to be cleaned.

Although the illustrative embodiment of the present invention has been described in detail with reference to the accompanying drawings, it is to be understood that the present invention is not limited to this embodiment. Various changes of modifications may be effected by one skilled in the art without departing from the scope or spirit of the invention.

What is claimed is:

1. A cleaning device for a printing cylinder, comprising:

a casing spaced from said printing cylinder, said casing having a bottom portion and an opening in another portion facing a confronting surface of said cylinder;

a rotary brush encased in said casing for brush-cleaning adhered substances from the surface of said printing cylinder, said rotary brush being rotationally driven, wherein a portion of said brush extends from said opening into selective contact with said printing cylinder;

a scraper disposed in said casing, for removing adhered substances from said rotary brush, said scraper contacting said rotary brush;

a vacuum means, formed in said casing, for generating a vacuum pressure to remove said substances from said casing; and air blowout means located within said casing for forming an air layer in the bottom portion of said casing and flowing the air layer towards said vacuum means to direct the substances removed from said brush toward said vacuum means.

2. The cleaning device for the printing cylinder according to claim 1, wherein said air blowout means is composed of a plurality of nozzle pipes having nozzles arranged in the axial direction of said rotary brush, said nozzle pipes defining a nozzle plane, and a blowout angle of said nozzles is set at an angle relative to said nozzle plane to direct said substances to said vacuum means.

3. The cleaning device for the printing cylinder according to claim 1, wherein said vacuum means comprises a dust discharge port in communication with said casing and an ejector in communication with said dust discharge port, wherein compressed air flows through said ejector thereby generating the vacuum pressure in said dust discharge port.

4. A cleaning device for a printing cylinder, comprising:

a casing spaced from said printing cylinder, said casing having an opening facing a confronting surface of said cylinder;

a dry rotary brush encased in said casing for brush-cleaning adhered substances from the surface of said printing cylinder, said dry rotary brush being rotationally driven, wherein a portion of said brush extends from said opening into selective contact with said printing cylinder;

a scraper disposed in said casing, for removing adhered substances from said rotary brush, said scraper contacting said rotary brush to deflect said substance into said casing;

a vacuum means, formed in said casing, for generating a vacuum pressure to remove said substances from said casing, said vacuum means comprising a dust discharge port in communication with said casing and an ejector in communication with said dust discharge port, wherein compressed air flows through said ejector thereby generating the vacuum pressure in said dust discharge port; and an air blowout means, composed of a plurality of nozzle pipes having nozzles arranged in the axial direction of said rotary brush in said casing, for forming an air layer in a bottom portion of said casing and flowing the air layer towards said vacuum means, to direct the substance removed from said brush toward said vacuum means.

5. The cleaning device for the printing cylinder according to claim 1, further comprising a cam means for reciprocating said rotary brush in the axial direction of said rotary brush.

6. The cleaning device for the printing cylinder according to claim 5, wherein said rotary brush is mounted on a rotatable shaft, said cam means comprising a cylindrical cam secured to said shaft having a cam groove, wherein a cam roller is disposed in said cam groove.

7. The cleaning device for a printing cylinder according to claim 2, wherein the nozzles are directed toward the bottom portion of the casing and the blowout angle is in the range of 20–25 degrees.

* * * * *